US005291956A

United States Patent [19]

Mueller et al.

[11] Patent Number: 5,291,956

[45] Date of Patent: Mar. 8, 1994

[54] COILED TUBING DRILLING APPARATUS AND METHOD

[75] Inventors: Mark D. Mueller; Julio M. Quintana; Robert M. Hinkel, all of Bakersfield, Calif.

[73] Assignee: Union Oil Company of California, Los Angeles, Calif.

[21] Appl. No.: 869,319

[22] Filed: Apr. 15, 1992

[51] Int. Cl.[5] ..... F21B 7/18; F21B 17/20

[52] U.S. Cl. ..... 175/67; 175/424

[58] Field of Search ..... 175/67, 424; 166/241; 299/17

[56] References Cited

U.S. PATENT DOCUMENTS

| | | | |
|---|---|---|---|
| 2,013,070 | 10/1934 | Sheridan . | |
| 3,100,542 | 5/1959 | Stark | 175/67 X |
| 3,804,182 | 4/1974 | Adair et al. | 175/1 |
| 3,838,742 | 10/1974 | Juvkam-Wold | 175/424 X |
| 3,856,095 | 12/1974 | Adair et al. | 175/203 |
| 4,787,465 | 11/1988 | Dickinson, III et al. | 175/67 |
| 4,790,394 | 12/1988 | Dickinson, III et al. | 175/61 |
| 4,850,440 | 7/1989 | Smet | 175/67 |
| 4,921,057 | 5/1990 | Smet | 175/203 |
| 5,040,605 | 8/1991 | Showalter | 166/61 X |
| 5,178,223 | 1/1993 | Smet | 175/424 |

OTHER PUBLICATIONS

"The Corrosion Behavior of Aluminum Pipe", 1983 National Association of Corrosion Engineers, Dec. 1983, pp. 9-12.

Drilling Technology Report, OGJ Special, "Coiled Tubing Used for Slim Hole Re-entry" Feb. 17, 1992, Oil & Gas Journal, pp. 45-51.

"Proposal to Develp and Evaluate Slim-Hole and Coiled-Tubing Technology" Maurer Engineering, Inc. Sep. 1991, TP91-17.

"Coiled Tubing . . . Operations and services", World Oil, Nov. 1991, pp. 41-47.

"Coil Tubing . . . Operations and Services", World Oil, Jan., 1992, pp. 95-101.

SPE 22959, "The Role of Coiled Tubing in the Western Operating Area of the Prudhoe Bay Unit" by E. J. Walker & D. R. Schmohr, BP Exploration (Alaska) Inc. 1991.

SPE 19543, "Improved Coiled-Tubing Squeeze Cementing Techniques at Prudhoe Bay", P. R. Hornbrook and C. M. Mason, BP Exploration, pp. 263-272, 1989.

SPE, 15104, "Coiled Tubing Cemente Squeeze Technique at Prudhoe Bay", Alaska, T. W. Harrison and C. G. Blount, ARCO, Alaska, Inc., pp. 115-122, 1986.

IADC/SPE 23876, "First Field Trial of a Coiled Tubing for Exploration Drilling" E. M. Traonmilin, J. M. Courteille, J. L. Bergerot, J. L. Reysset, Elf Aquitaine, and J. M. Y. Laffiche, Dowell Schlumberger, pp. 301-308, 1992.

"New Applications Developing for Coiled Tubing Service", by Brian K. Moore, and Larry Smith, Offshore, Dec. 1991, pp. 37-42.

*Primary Examiner*—David J. Bagnell

*Attorney, Agent, or Firm*—Gregory F. Wirzbicki; William O. Jacobson

[57] ABSTRACT

A low-cost method drilling and completing wells attaches a non-rotating jet drilling tool to coiled tubing. After drilling, the tubing portion outside the well is cut and the remaining tubing becomes the liner or casing for the well. By also using a residual bend remover, centralizers, and injecting a thermal cement slurry, very low cost steam injector wells can be drilled and completed.

36 Claims, 2 Drawing Sheets

FLUID RETURN
GUIDE
PUMP
MANI-
FOLD
CONTROLLER
L
2
3
4
5
6
7
8
9
10
11
12
13
14
15
16
17
18
19
19a
20
21

COILED TUBING DRILLING APPARATUS AND METHOD

FIELD OF THE INVENTION

This invention relates to a process for drilling and completing a well and the apparatus used in the process. More specifically, the invention is concerned with using coiled tubing in drilling a borehole in a subsurface formation and completing a thermal injection well within a producing oil field.

BACKGROUND OF THE INVENTION

Coiled tubing has been a useful apparatus in oil field drilling and related operations. A typical use is to measure or sample fluids downhole by placing one end of the coiled tubing into a borehole, lowering the end by unreeling the coiled tubing at the surface, obtaining the measurement or sample, and reeling the tubing end back up to the surface. Other applications have been to drill out scale and to provide a conduit during (non-drilling) open hole operations or cased hole workovers.

The potential to significantly reduce drilling costs by using coiled tubing instead of conventional drilling using drill pipe sections has been long recognized. Some of the potential cost saving factors include the running speed of coiled tubing units (which is normally much greater than conventional drilling rigs) and the reduced pipe handling time, pipe joint makeup time, and leakage risks using coiled tubing. Avoiding some drilling stops (e.g., to makeup a joint) by using coiled tubing can also reduce formation damage caused by interrupted mud circulation.

In spite of the significant potential cost savings by drilling with coiled tubing, only limited applications of coiled tubing to drilling and related processes are known. One application is to re-enter a vertical hole to deepen it over a relatively short distance (i.e., coiled tube drilling only the last and smallest portion). Another application is to re-enter a vertical hole to drill relatively short horizontal laterals. Completion applications of coiled tubing have been similarly limited.

The limited applications of coiled tubing are thought to be the result of problems normally experienced when using coiled tubing. One set of problems is related to the difficulties in trying to rotate coiled tubing. A conventional rotary drilling rig rotates the entire drill string from the surface (which rotates a rotary drill bit downhole), but because a portion of the coiled tubing remains on a drum (at the surface), a downhole motor is typically added near the bottom end of the coiled tubing to rotate the rotary drill head. The downhole motor adds complexity and cost.

Another set of problems is associated with the relatively thin walls of the coiled tubing. The thin walls are required to allow the tubing to be coiled on a reasonable diameter reel or drum at the surface (e.g., to be within maximum highway transport limitations). The thin walls limit differential pressures, rotational loads, hanging weight, and drilling forces that can be applied to the tubing. Thus, if a difficult-to-drill formation is encountered during the drilling of a well, drilling using coiled tubing may have to be abandoned with associated high costs. In part to compensate for these thin wall limitations, drilling with coiled tubing may be accomplished at higher rotational speeds. However, these higher speeds and the thin wall limitations typically require smaller diameter rotary drilling tools.

Another set of problems is associated with the residual bend in the coiled tubing. As the coiled tubing is uncoiled and straightened, a residual bend typically remains, i.e., most, but not all of the bend from coiling is removed. This residual bend can result in deviations from vertical (or the intended path) during drilling of the borehole. The amount of deviations may also change as different formations (and drilling loads) are encountered. The residual bend may also cause added contact and forces on the walls of the hole, resulting in increased frictional drag and an uncentered position of the tubing within the hole. The uneven loads can also cause early failure of the rotary drill bit.

Another set of problems is associated with the maximum tubing diameter. Although larger diameter tubing is available that could be coiled onto a large diameter drum, the larger drum size may not be highway transportable. The smaller (typically no more than 2⅜ inch or 6.03 cm) tubing diameters have limited coiled tubing drilling applications to "slim holes." These slim holes may be later reamed out by conventional drilling, if required, but the two step drilling process is costly. The smaller tubing diameters similarly limit completion applications. In addition to the limited production flow (because of limited cross-sectional area) capability of the smaller tubing in completed wells, the tubing size may also limit the downhole use of fishing tools, logging tools, production pumping equipment, etc.

Many of these problems using coiled tubing are particularly acute for thermal injection well applications, such as steam injection wells. Unplanned drilling deviations for a single injection well can result in early breakthrough and loss of many other production wells. Injection steam flow and pressure requirements may be beyond the pressure and diameter limitations of coiled tubing. The residual bend and uncentered tubing location within the hole during completion operations can lead to excessive thermal losses during steam injection.

SUMMARY OF THE INVENTION

Such problems are avoided in the present invention by attaching a jet drilling tool onto coilable tubing, supplying sufficient pressurized fluid to the drilling tool through the coilable tubing to jet drill a borehole at an upper location, unreeling the tubing while supplying the pressurized fluid until one end of the tubing reaches a lower location, supporting a first portion of said tubing at a location near the upper location, and separating the first tubing portion from the remaining tubing portion. By removing any residual bend in the tubing and centering it before inserting the tubing in the borehole, uncentered casing location problems and high thermal loss problems are avioded. Use of concentric or layered tubulars can further decrease thermal losses and provide greater fluid flow, pressure, and axial load carrying capability. The process results in a very low cost thermal injection well.

BRIEF DESCRIPTION OF THE DRAWINGS

In these Figures, it is to be understood that like reference numerals refer to like elements or features.

DETAILED DESCRIPTION OF THE INVENTION

Figure 1:
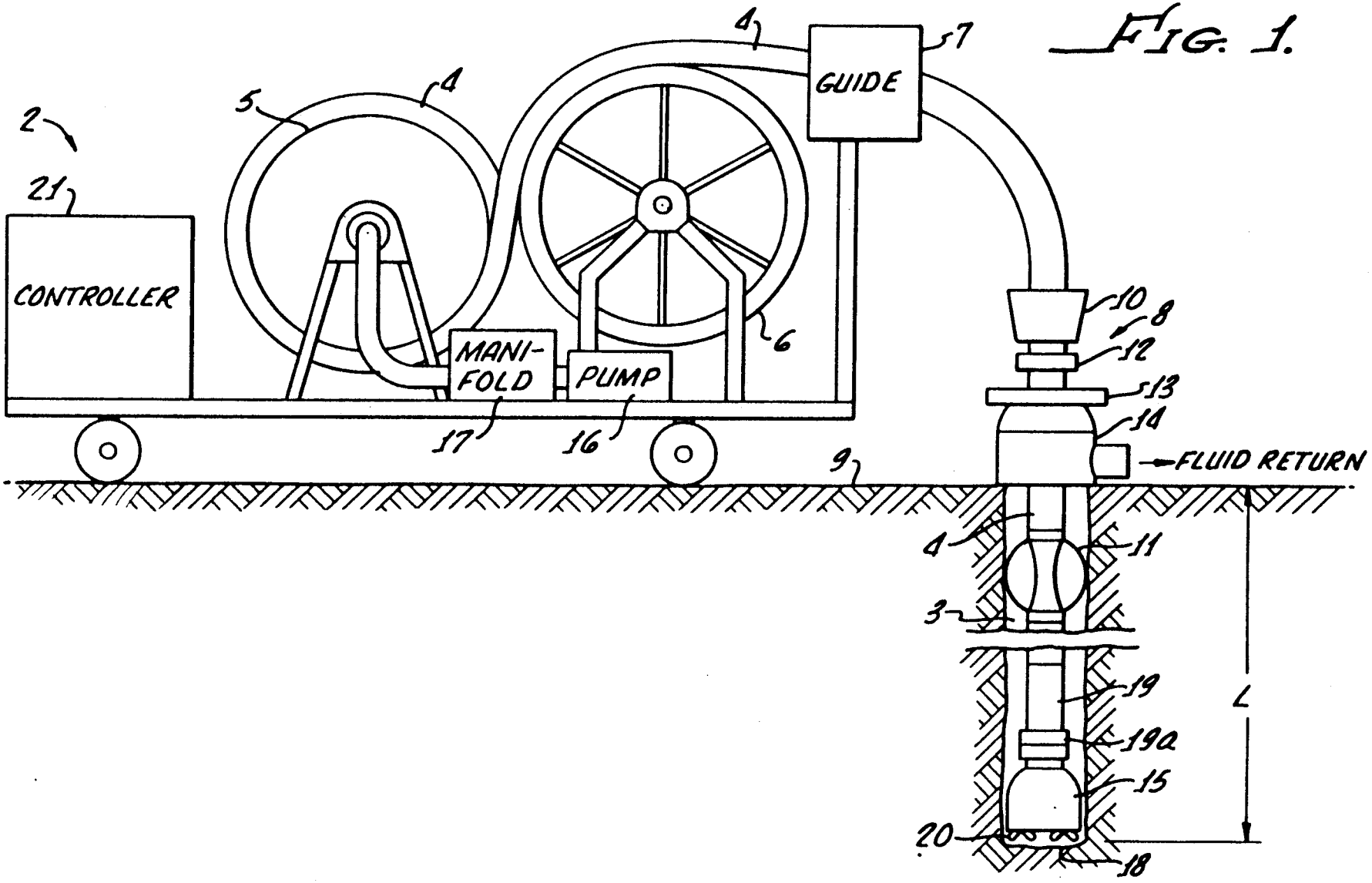
FIG. 1 shows a schematic side view of a coiled tubing trailer being used to drill a sectioned well.

FIG. 1 shows a schematic side view of a coiled tubing surface transport vehicle or trailer 2 with a partial cross-sectional view of a subsurface borehole 3 during drilling operations. The coiled tubing apparatus mounted on trailer 2 includes a continuous flexible conduit 4, such as tubing or hose or flexible metallic drill pipe, spooled on reeling means or drum 5. The drum 5 is rotatable around an axis perpendicular to the plane of FIG. 1, which allows the tubing 4 to be unreeled or reeled. Rotation of the drum 5 is accomplished by a means for rotating (not shown for clarity), such as a reversible electric motor for reeling and unreeling.

Although tubing 4 can be composed of many different materials, when a single homogeneous material is used, it is preferably an extruded tubing, preferably composed of steel. Other homogeneous tubing materials can include rubber and plastic.

In an alternative embodiment, the tubing 4 is composed of a multi-layered material, for example, Co-Flex TM or steel coated or lined with a plastic material layer. For thermal injection well applications, preferably at least one layer is steel for structural integrity, and another layer is a low thermal conductivity material, such as plastic. If the plastic layer is on the outside of tubing 4, it may also reduce drag as the tubing 4 is unreeled into the borehole 3.

A tubing material or material layer may also have non-isotropic properties, e.g., non-isotropic strength and stiffness, allowing the tubing 4 to bend more easily around the drum 5 while maintaining axial strength and pressure containment capability. A fiber impregnated plastic material is an example of a particularly useful non-isotropic tubing material.

Although the diameter of the tubing 4 is theoretically unlimited, the outside diameter of tubing 4 normally ranges from 1 to 3 inches (2.54 to 7.62 cm), preferably within the range of from 1½ to 2 inches (3.81 to 5.08 cm) in nominal outside diameter. Wall thickness is also theoretically unlimited, but practical drum 5 dimensions and other factors generally limit tubing wall thickness.

Another alternative embodiment uses multiple concentric tubes instead of a single homogeneous or multi-layer tubing. For example, the diameter of an inner concentric tube could be enlarged under pressure until the remainder of the pressure is constrained by the outer concentric tube. Assuming the inner tube remains at yield stress under pressure and the outer tube is at less than yield stress by a safe margin, the concentric tubes could withstand the same if not greater pressure than a single tube having a wall thickness comparable to the combined concentric tube wall thicknesses. The concentric tubes may also be able to be coiled onto a smaller diameter drum 5 when the pressure is removed.

Yet another alternative tubing-within-tubing embodiment connects in fluid tight arrangement the drilling head to the inner tubing only, allowing the more flexible and unpressurized outer tubing to be carried downhole. The inner tubing (and drilling head) could be removed after high pressure drilling and prior to completing the well (e.g., cementing the outer tubing in place).

A pulley 6 and a straightening guide 7 assist in straightening and guiding the unreeled tubing 4 into the borehole 3, but neither may be required in some applications. The straightening guide 7 may comprise repositionable, but otherwise fixed, tubing guides, as well as various rollers to help bend and unbend the unreeled tubing 4 going to or coming from the drum 5. Support for the straightening guide 7 may also be repositionable.

The pulley 6 and straightening guide 7 are a means to remove the residual bend left in the tubing 4 after unreeling from the drum 5, putting a slight reverse bend in the tubing 4. The diameter of pulley 6 and placement of guide 7 are selected to put a reverse bend in the uncoiled tubing 4 just sufficient to remove any residual bend. Any bending of the unreeled tubing 4 after the guide 7 would be limited to bending within the elastic range (i.e., bending where little or no residual bend results). The placement of guide 7 may need to be adjusted as coiled tubing is unreeled from different locations on the drum 5. In an alternative placement of the straightening guide 7, it would be placed over the borehole 3 to feed the straightened tubing 4 directly down to a tubing injector head and blowout preventer (BOP) stack 8.

The injector assembly 8 supports and guides the tubing 4 into or out of the center of the borehole 3. The injector assembly 8 comprises an injector head subassembly 10, a stuffing box subassembly 12, a blowout preventer subassembly 13, and a wellhead subassembly 14. The minimum diameter of the injector head subassembly 10 is sized to grip and drive the tubing into or out of the wellbore 3. Any devices attached to the tubing, such as centralizers 11, are typically attached after the tubing passes through the injector head subassembly 10.

The wellhead subassembly 14 provides an annular fluid flow space for drilling fluids flowing from the annulus between the tubing 4 and borehole 3. The drilling fluids exit via the "Fluid Return" port. Stuffing box assembly 12 serves to provide a fluid tight assembly.

The injector head assembly 8 is shown supported by ground surface 9, but alternative supports and centering guides may also be supported by the trailer 2 or other surfaces. In still other applications, the pulley 6 and/or straightening guide 7 may be eliminated or combined with the injector assembly.

Centralizers or bowsprings 11 can also be added to the tubing in this non-rotary drilling application. The preferred type of bowed (spring loaded) extensions variably contact the walls of the borehole 3, centering the tubing 4 even if the diameter of the borehole varies. The bowsprings allow a cement slurry to flow around the bowsprings in the annulus between the tubing 4 and borehole 3.

The non-contact jet drilling allows the weight of a drilling head 15 (and attached devices) to further straighten tubing 4 for vertical wells, resulting in little deviation of the borehole bottom from the planned borehole bottom location. The bottom of substantially vertical wells drilled using coiled tubing and having a depth or length "L" of approximately 1500 feet (457.2 meters) are expected to be located within approximately 15 feet (4.572 meters) of the planned lateral location at that depth (i.e., a deviation of less than 1 percent of the vertical depth). Even smaller deviations (e.g., within 10 feet or 3.048 meters or a deviation of substantially less than 1 percent) are not unexpected using the apparatus of the invention.

The stuffing box 12 may also serve as a means for wiping the outside diameter of the tubing 4. Wiping and cleaning the outside diameter of the tubing, especially if the tubing is polished, can reduce radiative heat transfer from the tubing to the walls of the borehole in a steam injection application. Alternative means for wiping include packings, O-rings, and stripping rubbers.

A tubing 4 portion within the borehole 3 is substantially centered within the borehole 3. Centering is accomplished by the injector assembly 8 and a series of bowsprings 11 attached to the tubing 4.

Attached at or near the bottom end of the tubing 4 is the jet drilling head 15. Pressurized fluid, such as a drilling mud, is supplied to the jet drilling head by means of a pump 16 through a pressure manifold 17 and tubing 4. Nozzles or orifices 20 are located at or near the bottom end of the jet drilling head 15 and are shaped and dimensioned to direct jets of pressurized fluid onto the subsurface formation material face 18. The force of the impacting (and/or cavitating) fluid jets on the face 18 cuts or dislodges material, deepening and drilling the borehole 3. Jets may also be located to widen the borehole 3.

The spent fluid (and entrained cuttings and/or dislodged materials) is returned back up to the surface (through the annular space between the borehole 3 and the tubing 4) and out towards the "Fluid Return". Although not shown for clarity, the fluids (and entrained solids) exiting the "Fluid Return" are typically filtered to remove the solids and recirculated to the fluid supply or suction of pump 16.

The fluid used to jet drill must have somewhat different properties when compared to conventional rotary drilling fluids. A typical jet drilling fluid is similar to a conventional rotary drilling mud, composed of bentonite (collodial bentonitic clay) and water, but the proportion of bentonite is generally less than in conventional drilling muds, preferably less by about 50 percent. Since this reduction in bentonite may result in a drilling mud that has insufficient gel strength, other additives, such as a polymer, may be added. This produces a drilling fluid that maintains an acceptable density, generally less than 9.0 lb/gal, and an acceptable gel strength for the application, but is less viscous than previously used. Other acceptable jet drilling fluid components can include salt water and foams.

Drilling fluid viscosity reduction of the present invention is limited by specific formation and drilling variables, such as a minimum viscosity which will entrain formation cuttings, but the reduction in viscosity can also be about 50 percent. Although variable, conventional drilling fluids can be expected to have a viscosity ranging from about 10–50 cp, more typically less than 30 cp, whereas the drilling fluids used in the present invention can range to as low as 1.0, preferably ranging from about 2 to 8 cp, most preferably less than 5 cp.

Fluid pressures must be sufficient to overcome tubing and annular friction losses to create a jet capable of drilling into (and removing material from) a face of the formation. Although maximum fluid pressures are theoretically unlimited, practical considerations (e.g., tubing pressure limitations and energy consumption) limit fluid pressures at the surface to below about 40,000 psig (2723 atm), usually below about 15,000 psig (1022 atm). More typically, the fluid pressures are below about 10,000 psig (681 atm) and most commonly range from about 1,000 to 5,000 psig (69 to 341 atm).

Fluid flow rates must be sufficient to jet drill and entrain cuttings in the return flow back up the annulus between the tubing and borehole. Although maximum fluid flowrates are theoretically unlimited, practical considerations (e.g., tubing size limitations and energy consumption) limit fluid flowrates at the surface to a range from about 1 to 10 gpm (0.0631 to 0.6308 liter/sec). More typically, the fluid flowrates are below 6 gpm (0.3784 liters/sec) and most commonly are below 4 gpm (0.2523 liters/sec).

Unlike conventional rotary drilling, the formation face 18 is ususally spaced apart from the jet drilling head 15. The spaced apart distance typically ranges from 0.05 to 1.0 inches (0.127 to 2.54 cm), but more typically ranges from 0.1 to 0.25 inches (0.254 to 0.635 cm).

The diameter of the drilling head 15 is typically larger than the diameter of the tubing 4. Jet drilling head diameters (or major cross-sectional dimension if the drilling head or tool has a non-circular cross-section) range from about 1.5 to 6.75 inches (3.81 to 17.145 cm), but more typically are at least 2 inches (5.08 cm) in diameter, preferably ranging from about 3 to 5 inches (7.62 to 12.7 cm) in outside diameter.

Nozzles or orifices 20 on the drilling head 15 are typically oriented to cut a borehole diameter larger than the diameter of the drilling head 15. This larger diameter borehole minimizes drag forces on the drilling head 15 (and tubing 4) and increases production or injection formation face areas, allowing greater production or injection fluid flowrates. The larger diameter may also reduce thermal losses in a thermal injection well application.

Because of a lack of rotation at the drilling head/formation face, the nozzles 20 should be oriented to assure material removal across the formation face 18 being jet drilled. This will typically require the flow axis of some nozzles or orifices to be non-parallel (angled) with respect to the borehole axis. The angled nozzles undercut material not directly impacted by the fluid jets, thereby increasing the drilling or cutting effectiveness.

The drilling head 15 may be directly attached to the end of the tubing 4, but preferably is attached to a coupling **19*a* at one end of a short, more rigid pipe section 19. The other end of the short pipe section 19 is attached to the end of the tubing 4. This short pipe section 19 may be as long as about 600 feet (182.9 meters), but more preferably ranges from about 15 to 60 feet (4.572 to 18.288 meters). The short section 19 and coupling 19*a* simplifies attachment of the drilling head 15 and minimizes lateral movement of the drilling head 15** during drilling resulting from factors such as unbalanced pressure and flow fluctuations through one or more nozzles. Stiff, heavy pipe attached to the bottom of the coiled tubing also acts like a pendulum weight on a string to keep the borehole vertical.

The drilling speed is controlled by a controller 21, such as a programmable controller. Optimum drilling speed is a function of many factors, including jet drilling fluid flowrate, drilling head 15 nozzle pattern, and formation properties. Fixed factors, such as nozzle pattern, can be inputted into the controller 21. Transducer outputs, such as a fluid flow sensor (not shown for clarity), can provide additional inputs to the programmable controller 21, controlling the means for rotating the drum 5 (and drilling speed). The controller can also be used to control other items, e.g., pump 16 and injector assembly 8.

The unreeling, tubing injection, or borehole drilling speed is theoretically nearly unlimited. However, practical considerations limit the drilling speed to a range from 0.1 to 1000 feet/hour (0.03048 to 304.8 meters/-hour). Typically, the drilling speed ranges from 1 500 feet/hour (0.3048 to 152.4 meters/hour).

Alternative embodiments can use a pressurized fluid slurry as the jet drilling fluid, the slurry comprising a fluid and entrained abrasive particles. The impact of the abrasive particles can assist in material cutting. However, the design and/or composition of the jet drilling head 15, especially at the nozzles or orifices, may have to be changed to use an abrasive slurry. For example, the drilling head 15 may be hardened to withstand the erosive effect generated by the flowing abrasive particles. The controller 21 may also be used to control the mixing of abrasive particles with the drilling fluid and proportion of abrasives in the final drilling fluid slurry mixture.

Figure 2:
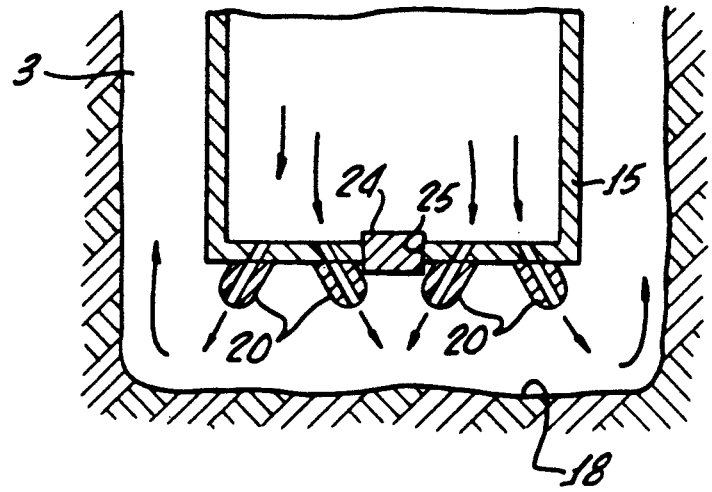
FIG. 2 shows a cross sectional view of the non-rotating jet drill bit.

FIG. 2 shows a partial cross-section view of the non-rotating jet drilling head 15 and several jet drilling orifices 20. The orifices 20 have fluid flow axes (shown by arrows entering and leaving orifices) which are oriented at an angle with respect to the borehole axis "A". In addition to undercutting, this orientation of the fluid jets emanating from the orifices can provide a pattern of jets which interact to further improve jet drilling performance at the face 18.

During drilling, a plug 24 blocks passageway 25. Plug 24 may be designed to blowout at a certain pressure or be frangible. When a pressure difference across the plug 24 is sufficient to blow out or rupture the plug, passageway 25 is opened for fluid flow.

Figure 3:
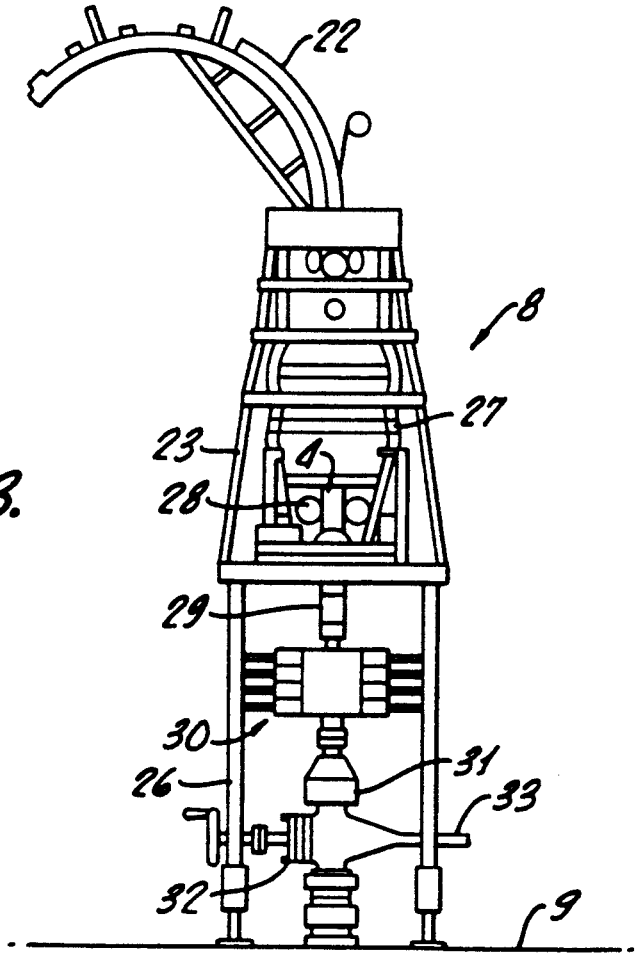
FIG. 3 shows a schematic side view of the injector assembly.

FIG. 3 is a more detailed schematic view of an injector assembly similar to the injector assembly 8 shown in FIG. 1. A second tubing guide 22 is attached to the frame structural support 23, which is supported by legs 26 resting on the ground surface 9.

An injector drive assembly 27 comprises gripper blocks mounted on a driven chain (not shown for clarity) feeding the tubing 4 into and out of a tubing guide 28. The driven chain can be controlled by controller 21 and replace the drum 5 driving means.

Tubing 4 to be injected into the borehole then passes through a stuffing box 29 and slide-lock blowout preventers 30. The stuffing box 29 typically includes an elastomer or packing for sealing or wiping. The blowout preventers are a quickly actuated means for sealing the tubing and/or annulus between the tubing and borehole.

The wellhead assembly 31 includes a wellhead valve 32 and a port 33 for fluid circulation or discharge. The wellhead valve 32 may or may not be operational during drilling because the tubing 4 may prevent valve closure. However, valve 32 may control the discharge from port 33 whether tubing 4 is in place or not.

After drilling to the lower location (at depth L below the surface as shown in FIG. 1), the portion of the tubing 4 in the borehole is ready to act as a casing for the well and be cemented in place, if required.

The typical process of completing a thermal injection well prior to steam injection would be to pump a cement slurry down the tubing portion and out to the annulus between the tubing 4 and the borehole 3. For this steam injection application, a thermal cement slurry would be used. The thermal cement must be able to withstand steam (or other thermal injection fluid) pressures and temperatures while maintaining structural integrity and a low thermal conductivity to non-selected portions of the formation. In addition to a cementitious material, thermal cement slurries typically also comprise a silica flour for these thermal purposes.

The cement slurry could be injected through the nozzles or orifices in the drilling head 15, but more likely new passages would be opened in the tubing or drilling head, for example, the passageway 25 shown in FIG. 2. Another option is to plug the orifices (for example by injecting balls) and perforate the tubing at another location.

Another cementing option is to install a bridge plug (blocking flow within the tubing 4 below the plug) at a desired level and perforate the tubing 4 above the bridge plug. Cement slurry is then flowed through the perforations. After the cement hardens, the bridge plug (and/or drilling head) may be removed, such as by drilling out. Additional perforations of the tubing 4 (and cement) may be accomplished at the injection zone of interest.

Alternatively, the tubing portion can be attached to a casing or other structure within the borehole 3. This would generally require affixing an attach fitting or hanger to the tubing 4 at the surface during drilling. After injection of the tubing 4 into the borehole during drilling is completed, the tubing 4 would extend to the surface, but the lower portion of the tubing 4 would be supported downhole by attach fitting.

Although the depth of the attach point within the well bore can theoretically range from near the surface (i.e., zero percent of the total depth) to near the bottom (i.e., one hundred percent of the total depth or distance to bottom), the attach point in this embodiment preferably ranges from nearly zero percent of the total depth to 50 percent of the total depth, more preferably from nearly zero percent of the total depth to 20 percent of the total depth, and most preferably from nearly zero percent of the total depth to 5 percent of the total depth.

If cementing of the tubing is not required, plug 24 (see FIG. 2) could be blown out (by increasing pressure) of passageway 25 and the well could function as an injector without the cost of cementing or perforation. To assist in blowing out plug 24, plugging balls (or other solids) having a diameter greater than orifices 20 could be first injected into the drilling fluid. When the balls land at orifices 20, the orifice flowrate would be restricted. The reduced flowrate would decrease friction losses, allowing a greater pressure drop to be generated across the plug 24.

Once the tubing is separately supported (e.g., by a casing hanger) or set (e.g., cemented in place), the portion of the tubing 4 substantially within the borehole 3 can be isolated (e.g., squeezed closed at the BOP), and separated from the rest of the tubing portion on the drum 5. The isolated tubing portion can now function as a conduit for pressurized thermal fluid (e.g., supplied at the fluid return port) to reach the underground formation.

Thermal fluid pressures vary. If steam is used, steam injection pressure must be sufficient to overcome formation pressure and friction losses for the flowrate required. Required steam quality will also impact injection pressure requirements.

The thermal fluid temperatures are theoretically unlimited, but practical considerations (e.g., formation integrity and energy consumption) normally limit thermal fluid temperatures at the surface to a range from about 100° to 700° F. (37.8° to 371.1° C.). More typically, the temperature ranges from 250° to 450° F. (121.1° to 232.2° C.).

The invention allows drilling and completion of better thermal injection wells in one continuous process. Tubing used for drilling may be larger and does not have to be removed. The drill tubing is hung and/or cemented to function as the well liner or casing.

Still other alternative embodiments are possible. These include: allowing the annulus of a tubing-inside-tubing embodiment to be evacuated or filled with a low conductivity material to further reduce thermal losses; using a downhole motor to rotate the centered drilling head during drilling; using an electrokinetic or other type of fluid which changes properties when exposed to an electric field and applying an electric field to the fluid when the fluid is downhole, for example placing an electroviscous fluid in the annulus between concentric tubings and applying an electric field between the tubings to stiffen the outer tubing; using air between concentric tubings to buoy up the weight of the tubings in a liquid filled borehole; adding a float collar to the assembly between the drilling head and tubing; having a plurality of hydraulic jet drilling heads, e.g., one for drilling down and another cutting a wider borehole; and having the drilling head composed of a thermally degrading material so that the drilling head would decompose upon exposure to steam injection fluid.

While the preferred embodiment of the invention has been shown and described, and various alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. A method for jet drilling and completing a well in a subsurface formation using tubing capable of being coiled upon a reel, the method comprising:

attaching a fluid jet drilling tool onto said coilable tubing, wherein said tool is capable of drilling a borehole in said formation;

supplying sufficient pressurized fluid to said drilling tool through said coilable tubing to jet drill said borehole from an upper location to a lower location;

unreeling said tubing from said reel while supplying said pressurized fluid until one end of said tubing reaches said lower location;

supporting a first portion of said tubing at a support located near said upper location after reaching said lower location; and separating said first tubing portion from the remaining tubing portion.

2. The method of claim 1 wherein said fluid jet tool is essentially non-rotating when drilling and which method also comprises:

flowing a cement slurry through said coilable tubing before said separating step; and removing said support after said cement slurry substantially hardens but before said separating step.

3. The method of claim 2 which also comprises:

sealing the annulus between the first tubing portion and said borehole at said upper location; and coiling the majority of said remaining tubing portion o said reel after said removing step.

4. The method of claim 3 which also comprises:

connecting in fluid tight arrangement said first tubing portion within said borehole to a thermal fluid supply; and injecting a thermal fluid from said thermal fluid supply into said formation through at least a portion of said first tubing portion, wherein said thermal fluid temperature at said thermal fluid supply is at least 121° C.

5. The method of claim 4 which also comprises:

centering said coilable tubing during said unreeling step; and attaching a plurality of centralizers along the length of said first coilable tubing portion, wherein said centralizers are separated from each other at approximately equal spaced apart distances.

6. The method of claim 5 which also comprises straightening said coilable tubing after said unreeling step, wherein said straightening removes the majority of any residual bend resulting from coiling said tubing on said reel.

7. The method of claim 6 wherein said straightening and said spaced apart distance are sufficient to prevent said tubing from contacting the walls of said borehole during said unreeling step.

8. The method of claim 7 wherein said straightening and said spaced apart distance are sufficient to prevent said tubing from approaching the walls of said borehole closer than 2.54 cm during said unreeling step.

9. The method of claim 8 wherein said pressurized fluid is a drilling fluid comprising bentonite and wherein said jet drilling drills said borehole along an axis at a rate in the range of from 0.3048 to 304.8 meters/hr.

10. The method of claim 9 wherein said drilling fluid comprises a slurry also comprising abrasive grit particles and wherein said fluid is supplied at a flowrate ranging from 0.0631 to 0.6308 liters/sec.

11. The method of claim 10 wherein said drilling tool has a major cross-sectional dimension of at least 3.81 cm, said tubing has a major cross-sectional dimension of at least 2.54 cm.

12. The method of claim 11 wherein said lower location is spaced apart from a desired lower location by a deviated distance and said deviated distance is no greater than 1 percent of the distance between said upper location and said lower location.

13. The method of claim 12 where said deviated distance is no greater than about 5 meters.

14. The method of claim 13 wherein said tubing is composed of multiple layers comprising different materials and said deviated distance after said unreeling step is no greater than about 3 meters.

15. The method of claim 14 wherein said tubing comprises an outer conduit composed of said multiple layers and an inner conduct composed of a non-isotropic material, wherein the majority of said inner conduit is spaced apart from said outer conduit and said deviated distance is substantially less than one percent of the distance between said upper and lower locations.

16. The method of claim 15 which also comprises the step of impressing a voltage difference between said inner and outer conduits and wherein said fluid composition comprises an electroviscous component.

17. An apparatus for drilling and casing a well from a first location to a second location within a subsurface formation comprising:

coilable tubing;

a driven drum supporting said tubing, said drum capable of reeling and unreeling said tubing;

a substantially non-rotatable hydraulic jet drilling head attached to said tubing;

means for unreeling said tubing and supplying a pressurized fluid to said drilling head in an amount sufficient to drill a borehole into said formation from said first location to at least said second location;

means for supporting a first portion of said tubing at a location near said first location; and means for separating said first tubing portion from the remaining tubing portion.

18. The apparatus of claim 17 which also comprises:

means for flowing a cement slurry through said coilable tubing; and means for removing the separated remaining tubing portion from near said first location without significantly disturbing the location of the first tubing portion.

19. The apparatus of claim 18 which also comprises:

means for attaching a tubing support device to said first tubing portion; and means for coiling a majority of said remaining tubing portion on said drum after removing said remaining tubing portion from said borehole.

20. The apparatus of claim 19 which also comprises:

means for connecting in fluid tight arrangement said first tubing portion to a thermal fluid supply; and means for injecting a thermal fluid from said thermal fluid supply into said formation through at least a part of said first tubing portion.

21. The apparatus of claim 20 which also comprises:

means for centering said coilable tubing within said borehole; and means for spacing apart said first tubing portion from said borehole.

22. The apparatus of claim 21 which also comprises means for straightening said coilable tubing sufficiently to remove the majority of any residual bend resulting from coiling said tubing on said drum.

23. The apparatus of claim 22 wherein said means for spacing apart comprises a plurality of centralizers attached to said first tubing portion and said spacing apart is at least about 2.54 cm.

24. The apparatus of claim 23 wherein said pressurized fluid is a drilling mud comprising bentonite.

25. The apparatus of claim 24 wherein said drilling mud also comprises abrasive grit particles.

26. The apparatus of claim 25 wherein said tubing has an outside diameter substantially in excess of about 6.03 cm.

27. The apparatus of claim 26 wherein said tubing is composed of multiple layers of different materials.

28. The apparatus of claim 27 wherein said tubing comprises an outer conduit composed of said multiple layers and an inner conduit composed of a non-isotropic material, wherein a majority of said inner conduit is spaced apart from said outer conduit.

29. The apparatus of claim 28 wherein the outer surface of said outer conduit is polished and said apparatus also comprises means for wiping said outer surface.

30. An apparatus for flowing thermal fluid to a subsurface formation comprising:

coilable tubing having a minimum nominal outside diameter in excess of about 5.08 cm;

a driven drum supporting said tubing, said drum capable of reeling and unreeling a majority of said said tubing;

means for unreeling said tubing;

means for jet drilling a borehole, said drilling means attached to said tubing, wherein said drilling means is capable of drilling substantially in the absence of rotation relative to said formation when said tubing is being unreeled; and means for flowing a thermal fluid through said tubing to said formation.

31. The apparatus claimed in claim 30 which also comprises a plurality of centralizers attached along the length of said tubing and wherein said tubing diameter is substantially in excess of 5.08 cm.

32. The apparatus claimed in claim 31 wherein said tubing is composed of a multi-layer material.

33. An apparatus for flowing fluid from a subsurface formation comprising:

a multilayered coilable tubing capable of unreeling from a drum, said tubing having a residual bend when reeled on said drum;

means for reverse bending;

means for jet drilling a borehole, said drilling means attached to said tubing, wherein said drilling means is capable of drilling substantially in the absence of rotation relative to said formation when said tubing is being unreeled; and means for flowing fluid from said formation through said tubing.

34. An apparatus for flowing fluid to a subsurface formation comprising:

a coilable tubing, said tubing capable of unreeling from a drum, said tubing comprising an inner conduit and an annular outer conduit both having a residual bend when reeled on said drum;

means for straightening said coilable tubing when said coilable tubing is unreeled from said drum;

means for jet drilling a borehole to said formation, wherein said jet drilling means is attached to said tubing; and means for flowing heated fluid to said formation through said inner conduit.

35. An apparatus for flowing fluid through a subsurface overburden between a subsurface formation location and a surface location, said apparatus comprising:

a coilable tubing, said tubing capable of unreeling from a drum and having a residual bend when reeled on said drum;

means for straightening said residual bend when said tubing is unreeled from said drum;

means attached to said tubing for drilling a borehole through said overburden to said formation when said drilling means is spaced apart from said overburden; and means for flowing fluid between said locations through said coilable tubing in the absence of a drill bit attached to said coilable tubing.

36. The apparatus of claim 35 wherein said drilling means comprises:

a jet drilling tool;

a source of pressurized abrasive slurry supplying said drilling tool; and a programmable controller for controlling the pressure and properties of said slurry.

* * * * *

UNITED STATES PATENT AND TRADEMARK OFFICE

CERTIFICATE OF CORRECTION

PATENT NO. : 5,291,956

DATED : March 8, 1994

INVENTOR(S) : Mueller et al.

It is certified that error appears in the above-indentified patent and that said Letters Patent is hereby corrected as shown below:

Claim 3, column 9, line 64, first word, delete "o" and insert -- on --.

Signed and Sealed this

Twenty-eighth Day of June, 1994

Bruce Lehman

*Attest:*

BRUCE LEHMAN

*Attesting Officer*

*Commissioner of Patents and Trademarks*